US005206133A

United States Patent [19]

Bando

[11] Patent Number: 5,206,133

[45] Date of Patent: Apr. 27, 1993

[54] SILVER HALIDE COLOR REVERSAL PHOTOGRAPHIC MATERIAL

[75] Inventor: Shinsuke Bando, Kanagawa, Japan

[73] Assignee: Fuji Photo Film Co., Ltd., Kanagawa, Japan

[21] Appl. No.: 770,784

[22] Filed: Oct. 4, 1991

Related U.S. Application Data

[63] Continuation of Ser. No. 624,506, Dec. 7, 1990, abandoned, which is a continuation of Ser. No. 235,812, Aug. 23, 1988, abandoned, which is a continuation of Ser. No. 887,771, Jul. 21, 1986, abandoned.

[30] Foreign Application Priority Data

Jul. 19, 1985 [JP] Japan ..... 60-158430

[51] Int. Cl.[5] ..... G03C 1/035

[52] U.S. Cl. ..... 430/567; 430/569

[58] Field of Search ..... 430/567, 569, 379

[56] References Cited

U.S. PATENT DOCUMENTS

| | | | |
|---|---|---|---|
| 4,210,450 | 7/1980 | Corben | 430/567 |
| 4,388,401 | 6/1983 | Hasebe et al. | 430/505 |
| 4,433,048 | 2/1984 | Solberg et al. | 430/434 |
| 4,444,874 | 4/1984 | Silverman et al. | 430/567 |
| 4,444,877 | 4/1984 | Koitabashi et al. | 430/567 |
| 4,477,564 | 10/1984 | Cellone et al. | 430/567 |
| 4,565,778 | 1/1986 | Miyamoto et al. | 430/567 |
| 4,581,328 | 4/1986 | Matsuyama | 430/567 |
| 4,614,711 | 9/1986 | Sugimoto et al. | 430/567 |
| 4,636,461 | 1/1987 | Becker et al. | 430/567 |

FOREIGN PATENT DOCUMENTS

| | | | |
|---|---|---|---|
| 0147868 | 7/1985 | European Pat. Off. | 430/567 |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A novel silver halide color reversal photographic material is provided having at least one light-sensitive silver halide cmulsion layer on a support, comprising silver halide grains contained in said at least one silver emulsion layer, said silver halide grains consisting of a core phase comprising the center thereof and a shell phase covering said core phase and comprising the surface thereof, and silver iodide content of said shell phase being higher than that of said core phase.

6 Claims, No Drawings

SILVER HALIDE COLOR REVERSAL PHOTOGRAPHIC MATERIAL

This is a continuation of application Ser. No. 07/624,506 filed Dec. 7, 1990, abandoned, which is a continuation of application Ser. No. 07/235,812 filed Aug. 23, 1988, abandoned, which is a continuation of application Ser. No. 06/887,771 filed Jul. 21, 1986, abandoned.

FIELD OF THE INVENTION

The present invention relates to a silver halide color reversal photographic material adapted for sensitized development.

BACKGROUND OF THE INVENTION

In general, a color reversal photographic light-sensitive material has a narrow exposure latitude range. It is therefore difficult to select exposure which provides optimum image over many different scenes. In a color reversal light-sensitive material, treatment time is often altered to provide desired images. In photographing scenes requiring high shutter speed or scenes short of light necessary for exposure by such a color reversal photographic light-sensitive material, it is usual that the sensitivity adjustment is accomplished by prolonging the development time to make up for the shortage of sensitivity. Such a sensitivity adjustment is generally called "sensitization processing". In such a color reversal photographic light-sensitive material, sensitization processing is accomplished by prolonging first development (black-and-white negative development).

In general, the treatment of a color reversal photographic light-sensitive material is conducted in the following steps:

Black-and-white development (first development)→stopping→rinsing→reversal→rinsing→color development→stopping→rinsing→adjustment bath→rinsing→bleaching→rinsing→fixation→rinsing→drying.

The first developing agent contains a silver halide solvent such as KSCN to cause a solution physical development which provides an effect of promoting the black-and-white development. Accordingly, in the first development of color reversal treatment, a so-called chemical development and a solution physical development take place at the same time. In other words, a solution physical development of nucleus of developed silver grains which have been exposed to form a latent image, or had a previously fogged nucleus and started to undergo chemical development, or colloidal silver contained in a yellow filter layer, takes place at the same time. Accordingly, in order to provide a color reversal photographic light-sensitive material adapted for sensitized development, it has been needed to design a silver halide emulsion which enables the controlling of not only the rate at which the chemical development proceeds but also the rate at which the solution physical development proceeds, depending on the development time.

In general, a silver halide color reversal photographic light-sensitive material comprises silver halide grains containing silver iodide. It is well known that in such silver halide grains the development speed can be controlled by the total silver iodide content thereof. For example, it is described in the *Journal of Photographic Science*, Vol. 24, pp. 198–202 (1976) that when silver halide grains having a high silver iodide content are used, the change in the amount of developed silver with development time can be increased even in a process in which only chemical development takes place or in a process in which a solution physical development is involved. However, when silver halide grains having a high silver iodide content are used, it is usual that the initial development is delayed, resulting in a drastic decrease in sensitivity upon shortening of the development time. It is also usual that the delayed development results in low contrast, making it impossible to provide desired images. Furthermore, silver halide grains having a very high silver iodide content remarkably inhibits the rate at which a solution physical development proceeds. Accordingly, the use of such silver halide grains may cause a rise in the minimum density (stain) or a reduction in contrast. Therefore, in a color reversal light-sensitive material, it is difficult to increase the sensitivity by the sensitization processing while obtaining desired images by increasing the total content of silver iodide in the silver halide grains.

In recent years, on the other hand, techniques for the preparation of silver halide grains have made progress, and attempts have been made to create a specific silver iodide distribution inside the grains of silver halide in order to control the development speed thereof. For example, it is described in *The International East-West Symposium on the Factors Influencing Photographic Sensitivity*, (B-27, 1984) that a so-called double structured grains in which silver iodide is present more in the inner phase (core) thereof and less on a phase (shell) including the surface thereof is advantageous from the viewpoint of sensitivity and development activity. It is also reported in the above described issue of *Journal of Photographic Science* that grains comprising a phase having a silver iodide content inside thereof undergo a chemical development at a higher speed than grains comprising a surface phase having a high silver iodide content.

However, such a structure is aimed at improving the development activity of the grain surface, accelerating the relatively early chemical development, while preventing the chemical development from processing into the grain beyond a predetermined limit during the last stage of the development. Accordingly, such a structure is essentially against the adaptability to the sensitization processing which requires an increase in the sensitivity change during the last stage of the development. Furthermore, in a color reversal treatment involving a vigorous solution physical development, grains containing an inner (core) phase having a high silver iodide content are difficult to dissolve in the developing agent after reaching the phase. This prevents the solution physical development from proceeding. This also results in a reduction in sensitization by high speed development, reduction in contrast, and a rise in minimum density (stain). Thus, a grain structure fully satisfying adaptability to high speed development of a color reversal photographic light-sensitive material has not yet been found.

SUMMARY OF THE INVENTION

In is therefore an object of the present invention to provide a silver halide color reversal photographic material which provides a higher increase in sensitivity by high speed development and a higher contrast when subjected to high speed development.

The above and other objects of the present invention will become more apparent from the following detailed description and examples.

The above object of the present invention can be accomplished by a color reversal photographic light-sensitive material comprising silver halide grains having a phase in which silver iodide is present less on the inside thereof, and a phase in which silver iodide is present more, on the outside thereof.

More particularly, the above object of the present invention can be accomplished by a silver halide color photographic material having at least one light-sensitive silver halide emulsion layer on a support, comprising silver halide grains contained in at least one silver halide emulsion layer, said silver halide grains consisting of a core phase comprising the center thereof and a shell phase covering said core and comprising the surface thereof, and the silver iodide content of said shell phase being higher than that of said core phase.

The use of the present silver halide grains enables appearance of a phase having a lower silver iodide content after the solution physical development proceeds to some extent. This further improves the solution physical development activity and thus provides a big increase in sensitivity by high speed development as compared to grains containing more silver iodide in the center thereof or grains having a uniform silver iodide distribution. Furthermore, the present silver halide grains have a higher solubility inside thereof. Therefore, in highlight portions, there is less silver halide grain left after the first development. Thus, as compared to grains containing more silver iodide inside thereof, the present silver halide grains provides a lower minimum density (stain) and a higher contrast. Furthermore, it is difficult to form fogged nucleus with the present silver halide grains, as compared to grains having less silver iodide content at the surface thereof. Therefore, by strengthening chemical sensitization, the present silver halide grains can further improve the increase in sensitivity by high speed development without losing the development activity obtained at the initial stage of the development. The present silver halide grains is also advantageous in that as compared to grains having less silver iodide content at the surface thereof, they provide less increase in fog due to high speed development during the first development, resulting in less decrease in the maximum density after color development.

DETAILED DESCRIPTION OF THE INVENTION

The silver halide color reversal photographic material of the present invention is a so-called conventional color reversal photographic light-sensitive material, using an intermediate black-and-white negative, which is developed by a color reversal process having a first development process using a black-and-white developer containing a chemical material capable of serving as a silver halide solvent and a process using a color developing agent.

The silver halide color reversal photographic material of the present invention generally has a plurality of silver halide emulsion layers having different color sensitivities, such as a blue-sensitive layer, a green-sensitive layer, and a red-sensitive layer, on a support.

The silver halide color reversal photographic material according to the present invention generally comprises a plurality of silver halide emulsion layers having the same color sensitivities but different sensitivities. The silver halide emulsion comprising the present silver halide grains may be applied to an emulsion layer of any color sensitivity or to an emulsion layer of any sensitivity. It goes without saying that simultaneous application of the silver halide grains according to the present invention to a plurality of emulsion layers further promotes the effects of the present invention.

As the silver halide, silver iodobromide is preferably used, but silver iodochlorobromide and silver iodochloride may also be used. When silver iodobromide is used, its silver iodide content is preferably 20 mol % or less, more preferably 10 mol % or less, and most preferably 5 mol %.

The silver halide grains to be used in the present invention comprise an inner core phase and a shell phase covering said core and containing the surface of the grain. The silver iodide content of the shell must be higher than that of the core. The difference between the core and the shell in silver iodide content is preferably at least 1 mol %, and more preferably 3 mol % or more.

The silver iodide content of the core is preferably 5 mol % or less, and more preferably 3 mol % or less. A core/shell structure in which the core is composed of silver bromide alone is one of preferred embodiments of the present invention. The silver iodide content of the shell is preferably in the range of from 3 to 40 mol %, and more preferably from 3 to 10 mol %.

The proper value of the ratio of silver content of the core to the shell depends on the total silver iodide content of the grain. However, the silver content of the core is preferably in the range of from 5 to 95%, and more preferably from 20 to 80%, based on the total silver content of the grain.

The core and/or the shell may further comprise a plurality of phases having different silver iodide contents. The disposition of these phases in the grain is not necessarily limited. However, it goes without saying that the suitable disposition is such that the silver iodide content of phases near the grain surface is higher than that of phases near the grain center.

The silver halide grains to be used in the present invention may have a structure such that the silver iodide content gradually increases from the center of the grain toward the surface thereof.

The silver halide grains to be used in the present invention may be in the form of a regular crystal such as cube, octahedron, and tetradehedron, or an irregular crystal such as sphere or in the form having crystalline defects such as a twin face, or in the form of a composite thereof. The present silver halide may be in the form of a mixture of grains having various crystalline forms. If the silver halide grains are in the form of non-tabular grains having a low aspect ratio, its layer structure is preferably such that the core is entirely covered by the shell. However, if the silver halide grains are in the form of tabular grains having a high aspect ratio, its layer structure may be such that the silver iodide content of the central zone (core) between the two main faces of a grain as described in U.S. Pat. No. 4,433,048 is low, while that of the zone near the surface thereof (shell) is high. The term "aspect ratio" as used herein means the ratio of the diameter of a circle having the same area as the projected area of the grain to the thickness of the grain. The diameter and thickness of the grain can be obtained from shadowed electron microphotograph as described in U.S. Pat. No. 4,436,226.

The silver iodide content of the grain surface can be determined by XPS (X-ray Photoelectron Spectoroscopy).

The silver halide grains to be used in the present invention may be in the form of finely divided grains having a diameter of about 0.1 μm or less, or large size grains having a projected area diameter of up to about 10 μm. The present silver halide grains may be used in the form of either a monodispersed emulsion having a narrow grain size distribution or polydispersed emulsion having a wide grain size distribution. However, one particularly preferred embodiment is monodispersed emulsion having a uniform grain size which can be easily controlled for proper silver iodide content of the grain. The term "monodispersed emulsion" as used herein means an emulsion comprising at least 95% by weight or number of silver halide grains having a grain diameter ranging ±20% from its average grain diameter. The process for the preparation of such an emulsion is described in U.S. Pat. Nos. 3,574,628 and 3,655,394 and British Patent 1,413,748. Other examples of monodispersed emulsions which are preferably used in the present invention include those described in Japanese Patent Application (OPI) Nos. 8600/73, 39027/76, 83097/76, 137133/78, 48521/79, 99419/79, 37635/83, and 49938/83 (the term "OPI" as used herein means an "unexamined published application").

To improve the sharpness and graininess of the present light-sensitive material, the silver halide grains are preferably tabular silver halide grains having an average aspect ratio of not less than 5 which are present so as to amount to at least 50% of the total projected area of all silver halide grains present. Application of such a tabular silver halide grains is described in detail in *Research Disclosure* RD No. 22534 (January 1983) and U.S. Pat. No. 4,434,226.

Alternatively, such a tabular grain material can be easily prepared by any one of processes described in *Photographic Science and Engineering* (edited by Gutoff) Vol. 14, pp. 248–257 (1970), U.S. Pat. Nos. 4,434,226, 4,414,310, 4,433,048, and 4,439,520, and British Patent 2,112,157.

The average aspect ratio of tabular silver halide grains used is preferably in the range of from 5 to 30, and more preferably in the range of from 5 to 8.

The present silver halide grains may be of either surface latent image type wherein latent images are formed on the surface thereof or internal latent image type as disclosed in U.S. Pat. No. 3,206,313 wherein latent images are formed inside the grain. Alternatively, the present silver halide grains may be in a form such that latent images are formed both on the surface and inside the grain. One of particularly preferred embodiments is internal latent image type which helps to improve increase in sensitivity by push development.

An internal latent type grain photographic material generally has chemically-sensitized portions inside the grain. These portions may be positioned in any positions inside the grain.

The silver halide photographic emulsion to be used in the present invention can be prepared by known processes as described, e.g., in *Research Disclosure*, "I. Emulsion Preparation and Types" Vol. 176, RD No. 17643, pp. 22–23 (December 1978) and Ibid., Vol. 187, RD No. 18716, pp. 648 (November 1979).

The photographic emulsion to be used in the present invention can be prepared by a suitable process as described in *Chimie et Physique Photographique*, by P. Glafkides, published by Paul Montel, 1967; *Photographic Emulsion Chemistry*, by G. F. Duffin, published by Focal Press, 1966; and *Making and Coating Photographic Emulsion*, by V. L. Zelikman et al, published by Focal Press, 1964. Particularly, the present photographic emulsion can be prepared by any one of the acidic process, neutral process, and ammonia process. The reaction of soluble silver salt with soluble halide may be accomplished by single jet process, double jet process or a combination thereof. Alternatively, the preparation of the present photographic emulsion may be accomplished by a so-called reverse mixing process in which silver halide grains are formed in the presence of excess silver ions. The double jet process can be accomplished for example, by a so-called controlled double jet process in which the pAg of the liquid phase wherein silver halide is formed is maintained constant. This process can produce a silver halide emulsion having a regular crystal form and a nearly uniform grain size.

Alternatively, the present photographic emulsion can be obtained by physical aging a known silver halide emulsion in the presence e.g., of ammonia, potassium rhodanide, and thioethers and thione compounds as described in U.S. Pat. No. 3,271,157, and Japanese Patent Application (OPI) Nos. 12360/76, 82408/78, 144319/78, 100717/79, and 155828/79. This process, too, can produce a silver halide emulsion having a regular crystal form and a nearly uniform grain size distribution.

The above-described silver halide emulsion comprising grains having a regular crystal form can be obtained by adjusting pAg and pH during the formation of the grains. Details are described, for example, in *Photographic Science and Engineering*, Vol. 6, pp. 159–165 (1962), *Journal of Photographic Science*, Vol. 12, pp. 242–251 (1964), U.S. Pat. No. 3,655,394 and British Patent 1,413,748. In the process of formation or physical aging of silver halide grains, cadmium salt, zinc salt, lead salt, thallium salt, iridium salt or iridium complex salt, rhodium salt or rhodium complex salt, or iron salt or iron complex salt may be present in order to effect sensitization, etc.

The removal of soluble silver salts from the emulsion before and after the physical aging can be accomplished by the noodle rinsing process, flocculation sedimentation process, or ultrafiltration process.

The emulsion used in the present invention is generally an emulsion which has been subjected to physical aging, chemical aging, and spectral sensitization. Examples of additives which are used in these processes are described, e.g., in *Research Disclosure*, RD No. 17643 (Dec. 1978) and Ibid., RD No. 18716 (November 1979). The places where those additives are described are summarized in the table below.

Examples of known photographic additives which can be used in the present invention are described in the above two issues of *Research Disclosure*. The places where the photographic additives are described are summarized in the table below.

| | Additive | RD 17643 | RD 18716 |
|---|---|---|---|
| 1. | Chemical sensitizing agent | page 23 | Right column on page 648 |
| 2. | Sensitivity improver | | |
| 3. | Spectral sensitizing agent, supersensitizing agent | pages 23–24 | Right column on 648 - right column on page 649 |
| 4. | Brightening agent | page 24 | |
| 5. | Fog inhibitor and stabilizer | pages 24–25 | Right column on page 649 |
| 6. | Light absrober, filter dye, ultraviolet absorber | pages 25–26 | Right column on page 649 - left column |

-continued

| | Additive | RD 17643 | RD 18716 |
|---|---|---|---|
| | | | on page 650 |
| 7. | Stain inhibitor | Right column on page 25 | Left column - right column on 650 |
| 8. | Dye image stabilizer | page 25 | |
| 9. | Hardener | page 26 | Left column on page 651 |
| 10. | Binder | page 26 | Left column on page 651 |
| 11. | Plasticizer, lubricant | page 27 | Right column on page 650 |
| 12. | Coating assistant, surface active agent | pages 26–27 | Right column on page 650 |
| 13. | Antistatic agent | page 27 | Right column on page 650 |

When such silver halide photographic emulsions are used in the present invention, various compounds may be preferably incorporated therein in order to inhibit fog in the process for the preparation, storage or photographic processing of light-sensitive materials or stabilize photographic properties. Examples of these various compounds which may be preferably incorporated in the present silver halide photographic emulsion include azoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (e.g., 1-phenyl-5-mercaptotetrazole), mercaptopyrimidines, mercaptotriazines, thioketo compounds such as oxazolinethiones, azaindens such as triazaindenes, tetraazaindenes (e.g., 4-hydroxy-substituted (1,3,3a,7) tetraazaindenes) and pentaazaindenes, and various compounds known as fog inhibitor or stabilizer such as benzenethiosulfonic acid, benzenesulfinic acid, and amide benzenesulfonate.

In the photographic materials according to the present invention, hydroquinones are preferably used which release a development inhibitor compound as described in U.S. Pat. Nos. 3,379,529 and 3,639,417 and naphthohydroquinones releasing a development inhibitor compound as described in *Research Disclosure*, RD No. 18264 (June 1979).

In the present invention, various color couplers can be used. Specific examples of such color couplers are described in patents cited in *Research Disclosure*, RD No. 17643, VII-C-G December 1978). As important dye forming coupler there may be employed a coupler which provides three primary colors in subtractive process (yellow, magenta, and cyan) through color development. Specific examples of anti-diffusive hydrophobic 4-equivalent or 2-equivalent couplers which may be preferably used in the present invention include those described hereinafter besides those described in the patents cited in *Research Disclosure*, RD No. 17643 (VII-C and D).

Typical examples of such a yellow coupler which may be used in the present invention include hydrophobic acylacetamide couplers having ballast groups. Specific examples of such an acylacetamide coupler are described in U.S. Pat. Nos. 2,407,210, 2,875,057, and 3,265,506. In the present invention, 2-equivalent yellow couplers are preferably used. Typical examples of such 2-equivalent yellow couplers include oxygen atom-releasing yellow couplers described in U.S. Pat. Nos. 3,408,194, 3,447,928, 3,933,501, and 4,022,620 and nitrogen atom-releasing yellow couplers described in Japanese Patent Publication No. 10739/83, U.S. Pat. Nos. 4,401,752 and 4,326,024, *Research Disclosure*, RD No. 18053 (April 1979), British Patent 1,425,020, and West German Patent Application (OLS) Nos. 2,219,917, 2,261,361, 2,329,587 and 2,433,812. α-benzoylacetanilide couplers are advantageous in that they can provide a high color density.

Magenta coupler that may be used in the photographic materials according to the present invention include hydrophobic indazolone or cyanoacetyl, preferably 5-pyrazolone or pyrazoloazole coupler having ballast groups. From the viewpoints of hue and color density of developed dye, 5-pyrazolone couplers having the 3-position substituted with an arylamino or acylamino group are preferably used. Typical examples of such couplers are described in U.S. Pat. Nos. 2,311,082, 2,343,703, 2,600,788, 2,908,573, 3,062,653, 3,152,896, and 3,936,015. As releasing groups for 2-equivalent 5-pyrazolone couplers there may be particularly preferably used nitrogen atom-releasing groups, as described in U.S. Pat. No. 4,310,619 and arylthio groups as described in U.S. Pat. No. 4,351,897. 5-pyrazolone couplers having ballast groups as described in European Patent 73,636 are advantageous in that they can provide a high color density. As pyrazoloazole couplers there may be used pyrazolobenzimidazoles as described in U.S. Pat. No. 3,061,432, preferably pyrazolo-[5,1-c][1,2,4]-triazoles as described in U.S. Pat. No. 3,725,067, pyrazolotetrazoles as described in *Research Disclosure*, RD No. 24220 (June, 1984) and Japanese Patent Application (OPI) No. 33552/85, or pyrazolopyrazoles as described in *Research Disclosure*, RD No. 24230 (June, 1984), and Japanese Patent Application (OPI) No. 43659/85. From the viewpoints of prevention of yellow side absorption of developed dye and fastness of developed dye to light, imidazol[1,2-b]pyrazoles as described in U.S. Pat. No. 4,500,630 are preferably used, and pyrazolo-[1,5-b]-[1,2,4] triazoles as described in EP-A-119,860 are particularly preferably used.

Cyan couplers which may be used in the present invention include hydrophobic anti-diffusive naphthol and phenol couplers such as naphthol coupler described in U.S. Pat. No. 2,474,293. Typical examples of naphthol couplers which may be preferably used in the present invention include oxygen atom-releasing 2-equivalent naphthol couplers as described in U.S. Pat. Nos. 4,052,212, 4,146,396, 4,228,233, and 4,296,200. Specific examples of phenol couplers are described in U.S. Pat. Nos. 2,369,929, 2,801,171, 2,772,162, and 2,895,826.

Cyan couplers fast to moisture and heat are preferably used in the present invention. Typical examples of such cyan couplers include phenol cyan couplers having its meta-position of phenol nucleus substituted with ethyl group or higher alkyl groups, as described in U.S. Pat. No. 3,772,002, 2,5-diacylamino-substituted phenol couplers as described in U.S. Pat. Nos. 2,772,162, 3,758,308, 4,126,396, 4,334,011, and 4,327,173, West German Patent Application (OLS) No. 3,329,729, and European Patent 121,365, and phenol couplers having its 2-position substituted with phenyl ureido group and its 5-position substituted with acylamino group as described in U.S. Pat. Nos. 3,446,622, 4,333,999, 4,451,559, and 4,427,767.

Besides the above couplers, couplers whose coloring dyes have an appropriate diffusivity may be used in order to improve graininess. Examples of such couplers include magenta couplers as described in U.S. Pat. No. 4,366,237 and British Patent 2,125,570 and yellow, magenta, and cyan couplers as described in European, Patent 96,570, and West German Patent Application (OLS) No. 3,234,533.

The above described dye-forming couplers may form dimers or higher polymers. Typical examples of polymerized dye-forming couplers are described in U.S. Pat. Nos. 3,451,820 and 4,080,211. Specific examples of polymerized magenta couplers are described in British Patent No. 2,102,173 and U.S. Pat. No. 4,367,282.

Couplers which release photographically useful residual groups upon coupling are preferably used in the present invention. As suitable DIR couplers which release a development inhibitor couplers as described in *Research Disclosure*, RD No. 17643, VII-F (December 1978) may be effectively used.

Preferred examples of couplers which may be used in combination with the above described couplers include developer deactivation type couplers as described in Japanese Patent Application (OPI) No. 151944/82, timing type couplers as described in U.S. Pat. No. 4,248,962 and Japanese Patent Application (OPI) No. 154234/82 and reactive type couplers as described in Japanese Patent Application (OPI) No. 184248/85. Particularly preferred examples of such couplers include developer deactivation type DIR couplers as described in Japanese Patent Application (OPI) Nos. 151944/82 and 217932/83, 218644/85, 225156/85, and 233650/85, and reactive DIR couplers as described in Japanese Patent Application (OPI) No. 184248/85.

The present couplers can be incorporated in the light-sensitive materials by means of various known dispersion processes. Typical examples of such dispersion processes include solid dispersion process, alkali dispersion process, latex dispersion process, and oil-in-water dispersion process. Preferred among these dispersion processes is latex dispersion process, and more preferred is oil-in-water dispersion process. In such an oil-in-water dispersion process, a coupler is dissolved in a single solution of a high boiling point organic solvent having a boiling point of 175° C. or above or a low boiling point so-called auxiliary solvent or a mixture thereof, and the resulting solution is finely dispersed in an aqueous such as water and water solution of gelatin in the presence of a surface active agent. Examples of such a high boiling point organic solvent are described in U.S. Pat. No. 2,322,027. The dispersion process may involve phase inversion. Furthermore, the auxiliary solvent may be removed or reduced by distillation, noodle rinsing, or ultrafiltration before the material is applied onto a support.

Specific examples of the process and effects of latex dispersion, and latexes that can be used for impregnation of the material are described in U.S. Pat. No. 4,199,363 and West German Patent Application (OLS) Nos. 2,541,274 and 2,541,230.

The photographic materials according to the present invention may contain a color fog inhibitor or color mixing inhibitor such as hydroquinone derivative, aminophenol derivative, amines, gallic acid derivative, catechol derivative, ascorbic acid derivative, non-coloring coupler, and sulfonamide phenol derivative.

In the photographic materials according to the present invention, various discoloration inhibitors may be used. Typical examples of organic discoloration inhibitors include hydroquinones, 6-hydroxychromans, 5-hydroxycoumaranes, spirochromans, p-alkoxyphenols, hindered phenols such as bisphenols, gallic acid derivatives, methylene dioxy benzenes, aminophenols, hindered amines, and ether or ester derivatives produced by silylating or alkylating phenolic hydroxide groups of these compounds. Alternatively, metal complexes such as (bissalicylaldoximate)nickel complex and (bis-N,N-dialkyldithiocarbamate) nickel complex.

The present invention can also be applied to a multi-layer multi-color photographic light-sensitive material having layers of at least two different spectral sensitivities on a support. A multi-layer natural color photographic light-sensitive material generally has at least one red-sensitive emulsion layer, green-sensitive emulsion layer, and blue-sensitive emulsion layer on a support. The configuration of these layers can be freely selected depending on the intended purpose. The preferred layer configuration is such that the support is covered by a red-sensitive layer, a green-sensitive layer, and then a blue-sensitive layer, or by a blue-sensitive layer, a red-sensitive layer, and then a green-sensitive layer. Alternatively, the above described emulsion layers may each comprise two or more emulsion layers having different sensitivities. Furthermore, a light-insensitive layer may be interposed between two or more emulsion layers having the same sensitivities. A general combination is such that the red-sensitive emulsion layer contains a cyan forming coupler, the green-sensitive emulsion layer contains a magenta forming coupler, and the blue-sensitive emulsion layer contains a yellow forming coupler. A different combination may optionally be used.

The present light-sensitive material is preferably provided with auxiliary layers such as protective layer, intermediate layer, filter layer, anti-halation layer, and backing layer in addition to the silver halide emulsion layers.

In the present photographic light-sensitive material, photographic emulsion layers and other layers are coated on a flexible support such as plastic film, paper and cloth or a rigid support such as glass, ceramics and metal, which are commonly used in photographic light-sensitive materials. As a useful flexible support there may be used a paper or the like coated or laminated with a cellulose derivative such as cellulose nitrate, cellulose acetate and cellulose acetolactate, a film of a synthetic polymeric compound such as polystyrene, polyvinyl chloride, polyethylene terephthalate and polycarbonate, baryta layer or α-olefin polymer such as polyethylene, polypropylene and ethylenebutene copolymer. The support may be colored with a dye or pigment. The support may be colored black for the purpose of light shielding. The sur-ace of the support is generally undercoated to facilitate its adhesion to the photographic emulsion layer or the like. The surface of the support may be subjected to glow discharge, corona discharge, irradiation with ultraviolet, or flame treatment before or after being undercoated.

The coating of the photographic emulsion layer or other hydrophilic colloid layers can be accomplished by any one of various known coating processes such as dip coating process, roller coating process, curtain coating process and extrusion coating process. A plurality of layers can be simultaneously coated by any one of coating processes described in U.S. Pat. No. 2,681,294, 2,761,791, 3,526,528, and 3,508,947.

The present color reversal photographic light-sensitive material can be developed by a color reversal treatment described in, for example, *Research Disclosure*, RD No. 17643 (page 28–29) and RD No. 18716 (left column to right column on page 651).

As previously described, the treatment of the present color reversal light-sensitive material is accomplished by the following steps:

Black-and-white development (1st development)→stopping→rinsing→reversal→rinsing→color development→stopping→rinsing→adjustment bath→rinsing→bleaching→rinsing→fixation→rinsing→stabilization→drying.

This process may further comprise pre-bath, prehardening bath, neutralizing bath, and other known processing steps. The rinsing after stopping, reversal, color development, adjustment bath, or bleaching may be omitted. The reversal may be conducted by a fogging bath or by re-exposure to light. Alternatively, the reversal may be omitted by adding a fogging agent to the color development bath. Furthermore, the adjustment bath may be omitted.

The rinsing process is generally arranged such that two or more tanks allow a counter-current flow system, whereby water can be saved. Besides the rinsing process step, typical examples of stabilization process include a multi-stage counter-current flow stabilization process as described in Japanese Patent Application (OPI) No. 8543/82. In the process of the present invention generally 2 to 9 tanks of counter-current flow bath are used. Various compounds are added to the present stabilization bath for the purpose of stabilization of images. For example, various buffers may be added to adjust the pH of the tank (to, for example 3 to 8). Typical examples of such a buffer include borates, methaborates, borax, phosphates, carbonates, potassium hydroxide, sodium hydroxide, ammonia water, monocarboxylic acid, dicarboxylic acid, and polycarboxylic acid, or combinations thereof. Alternatively, formalin may be added. Optionally, a water softener such as inorganic phosphoric acid, aminopolycarboxylic acid, aminopolyphosphonic acid and phosphonocarboxylic acid, a germicide such as benzoisothiazolinones, isothiazolones, 4-thiazolinebenzimidazoles, and phenol halides, a surface active agent, a fluorescent brightening agent, a hardener, or other additives may be used. Two or more compounds having the same or different purposes may be used in combination.

Examples of film pH adjustors which are preferably used after stabilization process include various ammonium salts such as ammonium chloride, ammonium nitrate, ammonium sulfate, ammonium phosphate, ammonium sulfite, and ammonium thiosulfate.

The present invention can be applied to various color reversal light-sensitive materials.

Typical examples of such color reversal light-sensitive materials include color reversal films for slide or television and color reversal papers. The present invention can be also applied to a black-and-white light-sensitive material utilizing mixing of three color couplers as described in Research Disclosure No. 17123 (July 1978).

The present invention will be further illustrated in the following examples, but the present invention is not to be construed as being limited thereto.

EXAMPLE 1

Aqueous solutions I to VIII as shown in Table 1 were prepared.

TABLE 1

| Solution | Composition |
|---|---|
| Solution I | Aqueous solution containing 30 g of inactive gelatin and 0.07 g/liter of KBr |
| Solution II | Aqueous solution containing 30 g of inactive gelatin and 8 g/liter of KBr |
| Solution III | Aqueous solution containing 170 g/liter of $AgNO_3$ |
| Solution IV | Aqueous solution containing 119 g/liter of KBr |
| Solution V | Aqueous solution containing 115.5 g/liter of KBr and 5 g/liter of KI |
| Solution VI | Aqueous solution containing 113.8 g/liter of KBr and 7.5 g/liter of KI |
| Solution VII | Aqueous solution containing 112 g/liter of KBr and 10 g/liter of KI |
| Solution VIII | Aqueous solution containing 108.5 g/liter of KBr and 15 g/liter of KI |

Solutions III to VIII were added to Solution I in a first and second stage while the formers were maintained at a constant flow rate, temperature and pAg to prepare emulsions A to J. The addition was accomplished by so-called double jet process. The details of the process are shown in Table 2.

After the addition was finished, each emulsion was desalted by a known process. The emulsions thus desalted were then subjected to optimum chemical sensitization by adding a proper amount of sodium thiosulfate and chloroauric acid thereto.

The grains contained in the silver halide emulsions A to J thus obtained showed a crystal habit substantially of cube. All the emulsions were monodispersed emulsions having a ratio of standard deviation of average particle size to mean value thereof from 10 to 15%. Table 3 shows the average grain size of the emulsions A to J, the total silver iodide content of the grains determined by X-ray diffraction, and the total silver iodide content of the grain surface determined by XPS (X-ray Photoelectron Spectroscopy). The results show that the emulsions A, E, F and G are emulsions containing silver halide grains in accordance with the present invention comprising relatively more silver iodide at the surface thereof, the emulsions B, C, H and I are emulsions containing grains having a relatively uniform silver iodide distribution the inside thereof, and the emulsions D and J are emulsions containing grains comprising relatively more silver halide on the thereof.

As shown in Table 4, the emulsions A to J were used as silver halide emulsion layers to prepare multi-layer reversal color light-sensitive materials 101 to 106 comprising various layers of the compositions shown below. The specimens 101 to 103 are of the present invention, and the specimens 104 to 106 are comparative.

TABLE 2

| | | | 1st Stage | | | 2nd Stage | | |
|---|---|---|---|---|---|---|---|---|
| | Temp. (°C.) | pAg | Aqueous solution of silver nitrate | Aqueous solution of halogen | Time for addition | Aqueous solution of silver nitrate | Aqueous solution of halogen | Time for addition |
| A | 80 | 7.1 | Solution III (294 ml) | Solution IV (294 ml) | 60 min. | Solution III (294 ml) | Solution VII (294 ml) | 50 min. |
| B | " | " | Solution III (294 ml) | Solution V (294 ml) | 68 min. | Soluton III (294 ml) | Solution V (294 ml) | 40 min. |

TABLE 2-continued

| | Temp. (°C.) | pAg | 1st Stage Aqueous solution of silver nitrate | 1st Stage Aqueous solution of halogen | 1st Stage Time for addition | 2nd Stage Aqueous solution of silver nitrate | 2nd Stage Aqueous solution of halogen | 2nd Stage Time for addition |
|---|---|---|---|---|---|---|---|---|
| C | " | " | Solution III (294 ml) | Solution VII (294 ml) | 95 min. | Solution III (294 ml) | Solution VII (294 ml) | 45 min. |
| D | " | " | Solution III (294 ml) | Solution VII (294 ml) | 95 min. | Solution III (294 ml) | Solution IV (294 ml) | 30 min. |
| E | 65 | 7.0 | Solution III (196 ml) | Solution IV (196 ml) | 16 min. | Solution III (392 ml) | Solution VI (392 ml) | 25 min. |
| F | " | " | Solution III (294 ml) | Solution IV (294 ml) | 24 min. | Solution III (294 ml) | Solution VII (294 ml) | 20 min. |
| G | " | " | Solution IV (392 ml) | Solution IV (392 ml) | 32 min. | Solution III (196 ml) | Solution VIII (196 ml) | 16 min. |
| H | " | " | Solution III (294 ml) | Solution V (294 ml) | 34 min. | Solution III (294 ml) | Solution V (294 ml) | 15 min. |
| I | " | " | Solution III (294 ml) | Solution VII (294 ml) | 52 min. | Solution III (294 ml) | Solution VII (294 ml) | 18 min. |
| J | " | " | Solution III (294 ml) | Solution VII (294 ml) | 52 min. | Solution III (294 ml) | Solution IV (294 ml) | 12 min. |

TABLE 3

| Emulsion | Average particle size (μm) | Total silver iodide content (mol %) | Silver iodide content of surface (mol%) |
|---|---|---|---|
| A | 0.62 | 3.0 | 5.7 |
| B | 0.61 | 3.0 | 3.1 |
| C | 0.60 | 6.0 | 5.9 |
| D | 0.61 | 3.0 | 0.2 |
| E | 0.28 | 3.0 | 4.1 |
| F | 0.28 | 3.0 | 5.6 |
| G | 0.28 | 3.0 | 8.5 |
| H | 0.27 | 3.0 | 3.0 |
| I | 0.27 | 6.0 | 5.9 |
| J | 0.28 | 3.0 | 0.5 |

TABLE 4

| Specimen No. | 3rd Layer | 4th Layer | 6th Layer | 7th Layer | 10th Layer | 11th Layer |
|---|---|---|---|---|---|---|
| 101 (present Invention) | Emulsion E | Emulsion A | Emulsion E | Emulsion A | Emulsion E | Emulsion A |
| 102 (present Invention) | Emulsion F | Emulsion A | Emulsion F | Emulsion A | Emulsion F | Emulsion A |
| 103 (present Invention) | Emulsion G | Emulsion A | Emulsion G | Emulsion A | Emulsion G | Emulsion A |
| 104 (Comparative Example) | Emulsion H | Emulsion B | Emulsion H | Emulsion B | Emulsion H | Emulsion B |
| 106 (Comparative Example) | Emulsion J | Emulsion D | Emulsion J | Emulsion D | Emulsion J | Emulsion D |

| | |
|---|---|
| 1st layer; anti-halation layer | |
| A gelatin layer (dry film thickness: 2 μm) containing: | |
| Black colloidal silver U-1 | 0.25 g/m$^2$ |
| ultraviolet absorber U-2 | 0.04 g/m$^2$ |
| Ultraviolet absorber U-3 | 0.1 g/m$^2$ |
| High boiling organic solvent $\overline{O}$-1 | 0.1 cc/m$^2$ |
| 2nd layer; intermediate layer | |
| A gelatin layer (dry film thickness: 1 μm) containing: | |
| Compound H-1 | 0.05 g/m$^2$ |
| High boiling organic solvent $\overline{O}$-2 | 0.05 cc/m$^2$ |
| 3rd layer; 1st red-sensitive emulsion layer | |
| A gelatin layer (dry film thickness: 1 μm) containing: | |
| Silver iodobromide emulsion shown in Table 4 spectrally sensitized by sensitizing dye S-1 and sensitizing dye S-2 (amount of silver) | 0.5 g/m$^2$ |

-continued

| | |
|---|---|
| Sensitizing dye S-1 | 1.50 mg/m$^2$ |
| Sensitizing dye S-2 | 0.25 mg/m$^2$ |
| Coupler C-1 | 0.25 g/m$^2$ |
| High boiling organic solvent $\overline{O}$-2 | 0.12 cc/m$^2$ |
| 4th layer, 2nd red-sensitive emulsion layer | |
| A gelatin layer (dry film thickness: 2.5 μm containing: | |
| Silver iodobromide emulsion shown in Table 4 spectrally sensitizied by sensitizing dye S-1' and sensitizing dye S-2 (amound of silver) | 0.8 g/m$^2$ |
| Sensitizing dye S-1 | 1.70 mg/m$^2$ |
| Sensitizing dye S-2 | 0.26 mg/m$^2$ |
| Coupler C-1 | 0.69 g/m$^2$ |
| High boiling organic solvent $\overline{O}$-2 | 0.33 cc/m$^2$ |
| 5th layer; intermediate layer | |
| A gelatin layer (dry film thickness: 1 μm) containing: | |
| Compound H-1 | 0.1 g/m$^2$ |
| High boiling organic solvent | 0.1 cc/m$^2$ |
| 6th layer; 1st green-sensitive emulsion layer | |
| A gelatin layer (dry film thickness: 1 μm) containing: | |
| Silver iodobromide emulsion shown in Table 4 spectrally sensitized by sensitizing dye S-3 and sensitizing dye S-4 (amount of silver) | 0.7 g/m$^2$ |
| Sensitizing due S-3 | 4.2 mg/m$^2$ |
| Sensitizing dye S-4 | 1.7 mg/m$^2$ |
| Coupler C-2 | 0.35 g/m$^2$ |
| High boiling organic solvent $\overline{O}$-2 | 0.26 cc/m$^2$ |
| 7th layer; 2nd green-sensitive emulsion layer | |
| A gelatin layer (dry film thickness: 2.5 μm) containing: | |
| Silver iodobromide emulsion shown in Table 4 spectrally sensitized by sensitizing dye S-3 and sensitizing dye S-4 (amount of silver) | 0.7 g/m$^2$ |
| Sensitizing dye S-3 | 1.5 mg/m$^2$ |
| Sensitizing dye S-4 | 0.6 mg/m$^2$ |
| Coupler C-3 | 0.25 g/m$^2$ |
| High boiling organic solvent $\overline{O}$-2 | 0.05 cc/m$^2$ |
| 8th layer: intermediate layer | |
| A gelatin layer (dry film thickness: 1 μm) containing: | |
| Compound H-1 | 0.058 g/m$^2$ |
| High boiling organic solvent $\overline{O}$-2 | 0.1 g/m$^2$ |
| 9th layer; yellow filter layer | |
| A gelatin layer (dry film thickenss: 1 μm) containing: | |
| Yellow colloidal silver | 0.1 g/m$^2$ |
| Compound H-1 | 0.0 g/m$^2$ |
| Compound H-2 | 0.03 g/m$^2$ |
| High boiling organic solvent $\overline{O}$-2 | 0.04 cc/m$^2$ |
| 10th layer; 1st blue-sensitive emulsion layer | |
| A gelatin layer (dry film thickness: 1.5 μm) containing: | |
| Silver iodobromide emulsion shown in Table 4 spectrally sensitized by sensitizing dye S-5 (amount of silver) | 0.6 g/m$^2$ |
| Dye S-5 | 1.2 mg/m$^2$ |
| Coupler C-4 | 0.5 g/m$^2$ |

-continued

| | |
|---|---|
| High boiling organic solvent $\overline{O}$-2 | 0.1 cc/m$^2$ |
| 11th layer; 2nd blue-sensitive emulsion layer | |
| A gelatin layer (dry film thickness: 3 μm) containing: | |
| Silver iodobromide emulsion shown in Table 4 spectrally sensitized by sensitizing dye S-5 (amount of silver) | 1.1 g/m$^2$ |
| Dye S-5 | 2.0 mg/m$^2$ |
| Coupler C-4 | 1.2 g/m$^2$ |
| High boiling organic sovlent $\overline{O}$-2 | 0.23 cc/m$^2$ |
| 12th layer; 1st protective layer | |
| A gelatin layer (dry film thickness: 2 μm) containing: | |
| Ultraviolet absorber U-1 | 0.02 g/m$^2$ |
| Ultraviolet absorber U-2 | 0.03 g/m$^2$ |
| Ultraviolet absorber U-3 | 0.03 g/m$^2$ |
| Ultraviolet absorber U-4 | 0.29 g/m$^2$ |
| High boiling organic solvent $\overline{O}$-1 | 0.28 cc/m$^2$ |

Besides the above compositions, a gelatin hardner H-4 and a surface active agent were added to the layers. The compounds used to prepare the specimens are shown below:

C-1

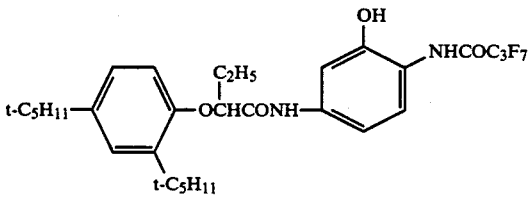

C-2

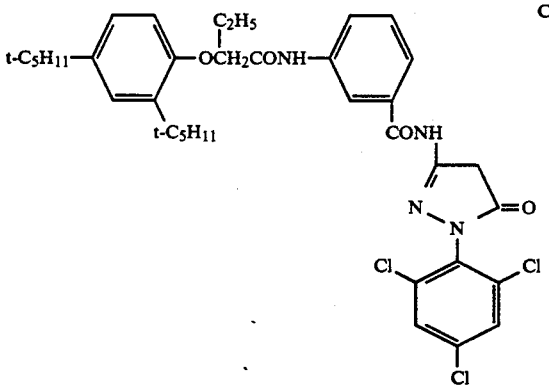

C-3

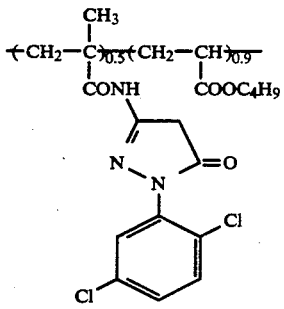

-continued

C-4

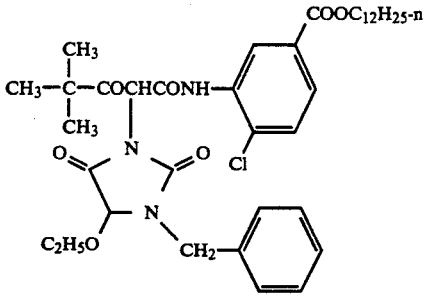

U-1

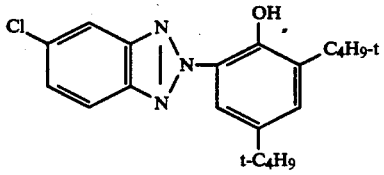

U-2

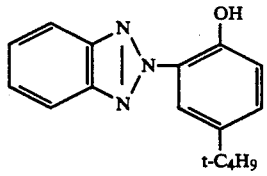

U-3

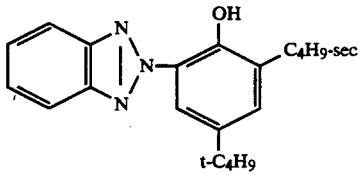

U-4

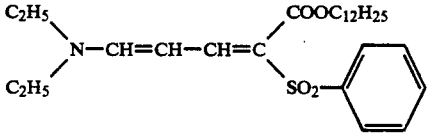

H-1

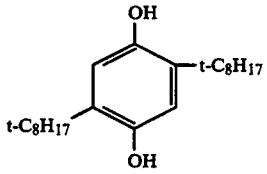

H-2

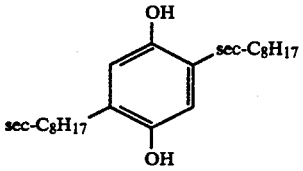

H-3

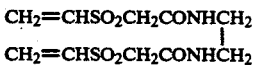

$\overline{O}$-1

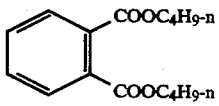

-continued

Ō-2

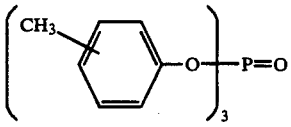

S-1

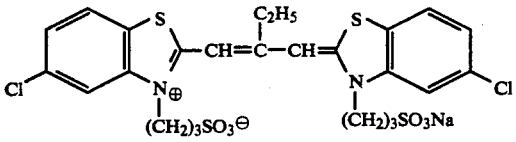

S-2

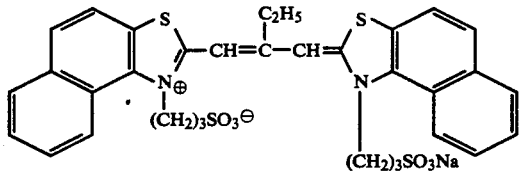

S-3

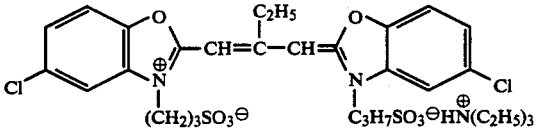

S-4

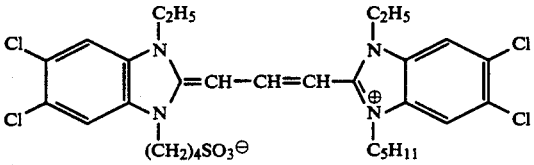

S-5

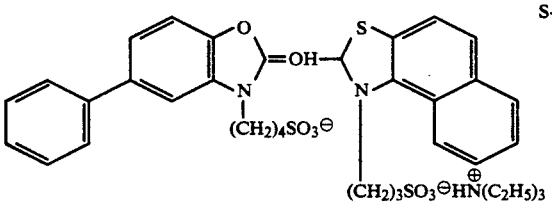

The specimens 101 to 106 were then wedgewise exposed to white light.

The specimens thus exposed were subjected to the following development:

| Step | Treatment process Time | Temp. |
|---|---|---|
| 1st development | 6 min. | 38° C. |
| Washing rinsing | 2 min. | " |
| Reversal | 2 min. | " |
| Color development | 6 min. | " |
| Adjustment | 2 min. | " |
| Bleaching | 6 min. | " |
| Fixation | 4 min. | " |
| Washing rinsing | 4 min. | " |
| Stabilization | 1 min. | Room temperature |
| Drying | | |

The following treatment compositions were used.

| 1st development bath | |
|---|---|
| Water | 700 ml |
| Nitrilo-N,N,N-pentasodium trimethylenephosphate | 2 g |
| Sodium sulfite | 20 g |
| Hydroquinone monosulfonate | 30 g |

-continued

| | |
|---|---|
| Sodium carbonate (monohydrate) | 30 g |
| 1-phenyl-4-methyl-4-hydroxymethyl-3 pyrazolidone | 2 g |
| Potassium bromide | 2.5 g |
| Potassium thiocyanate | 1.2 g |
| Potassium iodide (0.1% solution) | 2 ml |
| Water to make | 1,000 ml (pH 9.6) |
| **Reversal bath** | |
| Water | 700 ml |
| Nitrilo-N,N,N-pentasodium trimethylenephosphate | 3 g |
| Stannous chloride (dihydrate) | 1 g |
| p-aminophenol | 0.1 g |
| Sodium hydroxide | 8 g |
| Glacial acetic acid | 15 ml |
| Water to make | 1,000 ml (pH 5.5) |
| **Color development bath** | |
| Water | 700 ml |
| Nitrilo-N,N,N-pentasodium trimethylenephosphate | 3 g |
| Stannous chloride (dihydrate) | 1 g |
| Sodium sulfite | 7 g |
| Tribasic sodium phosphate (dodecahydrate) | 36 g |
| Potassium bromide | 1 g |
| Potassium iodide (0.1% solution) | 90 ml |
| Sodium hydroxide | 3 g |
| Citrazinic acid | 1.5 g |
| N-Ethyl-N-(β-methanesulfonamidoethyl)-3-methyl-4-sulfate aminoaniline | 11 g |
| 3,6-Dithiaoctane-1,8-diol | 1 g |
| Water to make | 1,000 ml (pH 11.8) |
| **Adjustment bath** | |
| Water | 700 ml |
| Sodium sulfite | 12 g |
| Sodium ethylenediaminetetraacetate (dihydrate) | 8 g |
| Thioglycerine | 0.4 ml |
| Glacial acetic acid | 3 ml |
| Water to make | 1,000 ml (pH 6.15) |
| **Bleaching bath** | |
| Water | 800 g |
| Sodium ethylenediaminetetraacetate (dihydrate) | 2 g |
| Ferric ammonium ethylenediaminetetraacetate (dihydrate) | 120 g |
| Potassium bromide | 100 g |
| Water to make | 1,000 ml (pH 5.6) |
| **Fixing bath** | |
| Water | 800 ml |
| Sodium thiosulfate | 80.0 g |
| Sodium sulfite | 5.0 g |
| Sodium bisulfite | 5.0 g |
| Water to make | 1,000 ml (pH 6.6) |
| **Stabilizing agent** | |
| Water | 800 ml |
| Formalin (37 wt % formaldehyde solution) | 5.0 ml |
| Fuji Driwell (surface active agent produced by Fuji Film) | 5.0 ml |
| Water to make | 1,000 ml |

Furthermore, a desensitization process in which the first development is conducted for a shortened period of time (5 min.) and a sensitization processing in which the first development is conducted for a prolonged period of time (8 min.) were carried out.

After these treatments, the density of cyan images, magenta images and yellow images were measured, and characteristic curves were drawn from the measurement. The relative sensitivity, gamma (index of contrast), minimum density, and maximum density were determined from the characteristic curves. Table 5 typically shows the value of these parameters of magenta images.

As is clear from Table 5, the specimens 101 to 103 of the present invention, which contain grains having a structure such that silver iodide is present less inside thereof and more on the surface thereof, are advantageous in that while they have sensitivities of the same level as that of specimen 105 when subjected to the sensitization process, they provide higher sensitivities for development times less than that of the standard development, higher contrast, and lower minimum densities as compared to specimen 105.

Furthermore, it can been seen that the specimens of the present invention are advantageous in that they provide higher sensitivities, lower minimum densities, and higher contrast when subjected to the sensitization process without causing a drastic desensitization or decrease in contrast due to shortening of development time as compared to specimen 104, which contains grains having a uniform silver iodide distribution, or specimen 106, which contains grains having a structure such that silver iodide is present relatively more inside thereof.

TABLE 5

| Specimen | 1st development time (min.) | Relative sensitivity* | Gamma** | Minimum density | Maximum density |
|---|---|---|---|---|---|
| 101 | 5 | 65 | 1.35 | 0.14 | 3.62 |
| | 6 | 108 | 1.60 | 0.19 | 3.52 |
| | 8 | 230 | 1.90 | 0.11 | 3.24 |
| 102 | 5 | 65 | 1.40 | 0.18 | 3.65 |
| | 6 | 100 | 1.63 | 0.13 | 3.50 |
| | 8 | 240 | 1.95 | 0.11 | 3.35 |
| 103 | 5 | 60 | 1.33 | 0.20 | 3.67 |
| | 6 | 100 | 1.55 | 0.13 | 3.58 |
| | 8 | 235 | 2.00 | 0.11 | 3.45 |
| 104 | 5 | 65 | 1.33 | 0.20 | 3.60 |
| | 6 | 100 | 1.51 | 0.14 | 3.44 |
| | 8 | 210 | 1.90 | 0.12 | 3.15 |
| 105 | 5 | 30 | 1.10 | 0.35 | 3.65 |
| | 6 | 80 | 1.33 | 0.31 | 3.52 |
| | 8 | 184 | 1.65 | 0.27 | 3.36 |
| 106 | 5 | 70 | 1.30 | 0.22 | 3.55 |
| | 6 | 100 | 1.43 | 0.14 | 3.35 |
| | 8 | 195 | 1.83 | 0.13 | 2.95 |

*Sensitivity determined from the reciprocal of the exposure which gives a density 0.2 higher than the minimum density of the relative sensitivity. The sensitivity of the specimen 101 when it is subjected to the standard treatment (1st development: 6 min.) is taken as 100.

**Gamma is represented by the slope of the line between the point giving sensitivity and the point at which the density is 2.0 on the characteristic curve.

EXAMPLE 2

Solutions III, IV, and VI were added to Solution II shown in Table II by means of double jet process at a first stage, second stage and third stage while the former were maintained at a constant flow rate and temperature to prepare emulsions K to M. The details are shown in Table 6.

After the addition was finished, these emulsions were desalted in the same manner as used for the emulsions A to J of Example 1. The emulsions thus desalted were then subjected to an optimum chemical sensitization in the same manner as used in Example 1.

The particles contained in the silver halide emulsions K to M were tabular grains of silver halide having an average aspect ratio of from 6.8 to 7.6. Table 7 shows the average projected area diameter and average aspect ratio of the emulsions K to M. The silver halide grains contained in the emulsion K are grains of the present invention in which silver iodide is present more on the surface or circumference thereof. The silver halide grains contained in the emulsion L are grains having a substantially uniform silver iodide distribution. The silver halide grains contained in the emulsion M are grains in which silver iodide is present more inside or in the center thereof.

Specimens 201 to 203 were prepared in the same compositions as used for the specimens 101 to 106 of Example 1 except in that the emulsions K to M and the above described emulsions F, H and J were used, as shown in Table 8.

TABLE 6

| | | 1st stage | | | 2nd stage | | | 3rd stage | | |
|---|---|---|---|---|---|---|---|---|---|---|
| Emulsion | Temp. | Aqueous solution of silver nitrate | Aqueous solution of halogen | Time for addition | Aqueous solution of silver nitrate | Aqueous solution of halogen | Time for addition | Aqueous solution of silver nitrate | Aqueous solution of halogen | Time for addition |
| K | 60° C. | Solution III (29 ml) | Solution IV (29.4 ml) | 10 sec. | Solution III (265 ml) | Solution IV (265 ml) | 31 min. | Solution III (294 ml) | Solution VIII (294 ml) | 34 min. |
| L | " | Solution III (29 ml) | | " | Solution III (294 ml) | Solution VI (294 ml) | 34 min. | Solution III (265 ml) | Solution VI (265 ml) | 31 min. |
| M | " | Solution III (29 ml) | | " | Solution III (294 ml) | Solution VIII (294 ml) | " | Solution III (265 ml) | Solution IV (265 ml) | " |

TABLE 7

| Emulsion | Average projected area diameter | Average aspect ratio |
|---|---|---|
| K | 1.1 μm | 7.6 |
| L | 1.1 μm | 7.3 |
| M | 1.0 μm | 6.8 |

These emulsions were coated on supports to prepare specimens specimens 201 to 203. The specimen 201 was of the present invention, and the specimens 202 and 203 were comparative.

The specimens 201 to 203 were then wedgewise exposed to white light. These specimens were subjected to development comprising first development lasting 6 min. (standard) and 8 min. (sensitization). These specimens were then subjected to sensitometry. Table 9 typically shows the value of various parameters of yellow images determined in the same manner as in Example 1.

As is clean from Table 9, the specimen 201 of the present invention, which contains grains having a structure such that silver iodide is present relatively less inside thereof and relatively more on the surface thereof, is advantageous in that it provides a higher sensitivity upon sensitization process without causing a drastic desensitization or decrease in contrast due to shortening of the development time as compared to the specimen 202, which contains grains having a substantially uniform silver iodide distribution, or the specimen 203, which contains grains having a structure such that silver iodide is present more inside thereof. Furthermore, the specimen 201 is advantageous in that it always provides a higher maximum density and a higher contrast as compared to the specimens 201 and 203.

TABLE 8

| Specimen No. | 3rd Layer | 4th Layer | 6th Layer | 7th Layer | 10th Layer | 11th Layer |
|---|---|---|---|---|---|---|
| 201 (present invention) | Emulsion F | Emulsion K | Emulsion F | Emulsion K | Emulsion F | Emulsion K |
| 202 (comparative) | Emulsion H | Emulsion L | Emulsion H | Emulsion L | Emulsion H | Emulsion L |
| 203 (comparative) | Emulsion J | Emulsion M | Emulsion J | Emulsion M | Emulsion J | Emulsion M |

TABLE 9

| Specimen | 1st development time | Relative sensitivity* | Gamma | Minimum density | Maximum density |
|---|---|---|---|---|---|
| 201 | 6 | 100 | 1.50 | 0.12 | 3.25 |
| | 8 | 235 | 1.85 | 0.10 | 3.10 |
| 202 | 6 | 100 | 1.45 | 0.13 | 3.00 |
| | 8 | 200 | 1.78 | 0.10 | 2.80 |
| 203 | 6 | 100 | 1.40 | 0.13 | 2.85 |
| | 8 | 210 | 1.70 | 0.10 | 2.60 |

*Value relative to the sensitivity of the specimen 201 when it is subjected to standard treatment (6 min.)

EXAMPLE 3

TABLE 10

| Emulsion | Temp. (°C.) | pAg | 1st stage: Aqueous solution of silver nitrate | 1st stage: Aqueous solution of halogen | 1st stage: Time for addition | 2nd stage: Aqueous solution of silver nitrate | 2nd stage: Aqueous solution of halogen | 2nd stage: Time for addition | 3rd stage: Aqueous solution of silver nitrate | 3rd stage: Aqueous solution of halogen | 3rd stage: Time for addition |
|---|---|---|---|---|---|---|---|---|---|---|---|
| N | 80 | 7.1 | Solution III (294 ml) | Solution IV (294 ml) | 60 min. | Solution III (118 ml) | Solution VII (118 ml) | 20 min. | Solution III (176 ml) | Solution VII (118 ml) | 30 min. |
| $\overline{O}$ | " | " | Solution III (294 ml) | Solution V (294 ml) | 68 min. | Solution III (118 ml) | Solution V (118 ml) | 16 min. | Solution III (176 ml) | Solution V (118 ml) | 24 min. |
| P | " | " | Solution III (294 ml) | Solution VII (294 ml) | 95 min. | Solution III (118 ml) | Solution IV (118 ml) | 12 min. | Solution III (176 ml) | Solution IV (118 ml) | 18 min. |
| Q | 65 | 7.0 | Solution III (294 ml) | Solution IV (294 ml) | 24 min. | Solution III (118 ml) | Solution VII (118 ml) | 8 min. | Solution III (176 ml) | Solution VII (118 ml) | 12 min. |
| R | " | " | Solution III (294 ml) | Solution V (294 ml) | 34 min. | Solution III (118 ml) | Solution V (118 ml) | 6 min. | Solution III (176 ml) | Solution V (118 ml) | 9 min. |
| S | " | " | Solution III (294 ml) | Solution VII (294 ml) | 52 min. | Solution III (118 ml) | Solution IV (118 ml) | 5 min. | Solution III (176 ml) | Solution IV (118 ml) | 7 min. |

Solutions III, IV, V, or VII were added to Solution I shown in Table I in a first stage and second stage by means of the double jet process while the former solutions were maintained at a constant flow rate, pAg, and temperature. After the addition was finished, the resulting emulsions were subjected to chemical sensitization by adding proper amounts of sodium thiosulfate and chloroauric acid. Furthermore, Solutions III, IV, V or VII were added to these emulsions in a third stage by means of double jet process while the former solutions were maintained at a constant flow rate, temperature and pAg. Thus, emulsions N to S were prepared. The details are shown in Table 10. After the addition, was finished, the resulting emulsions were desalted in the same manner as used for the emulsions A to J of Example 1.

The silver halide emulsions N to S were emulsions containing grains having the same crystal habit and grains size distribution as the emulsions A, B, C, F, H and J. These emulsions were coated on supports to prepare specimens. The specimens were then subjected to development by a surface developing agent A and an internal developing agent B at a temperature of 20° C. for 5 minutes. The specimens thus developed were tested for sensitometry. As a result, it was found that the sensitivity obtained by the internal developing agent B is 10 or more times higher than that obtained by the surface developing agent A, and the emulsions N to S are, therefore, internal latent image type emulsions.

| | |
|---|---|
| **Developing agent A** | |
| N-methyl-p-aminophenolsulfate | 2.5 g |
| Ascorbic acid | 10.0 g |
| Potassium methasulfate | 35.0 g |
| Potassium bromide | 1.0 g |
| Water to make | 1,000 ml (pH 9.6) |
| **Developing agent B** | |
| N-methyl-p-aminophenolsulfate | 2.0 g |
| Sodium sulfite (dried) | 90.0 g |
| Hydroquinone | 8.0 g |
| Sodium carbonate (monohydrate) | 52.5 g |
| Potassium bromide | 5.0 g |
| Sodium thiosulfate | 10.0 g |
| Water to make | 1,000 ml (pH 9.6) |

TABLE 11

| Specimen No. | 3rd Layer | 4th Layer | 6th Layer | 7th Layer | 10th Layer | 11th Layer |
|---|---|---|---|---|---|---|
| 301 (present invention) | Emulsion Q | Emulsion N | Emulsion Q | Emulsion N | Emulsion Q | Emulsion N |
| 302 (comparative) | Emulsion R | Emulsion $\overline{O}$ | Emulsion R | Emulsion $\overline{O}$ | Emulsion R | Emulsion $\overline{O}$ |
| 303 (comparative) | Emulsion S | Emulsion P | Emulsion S | Emulsion P | Emulsion S | Emulsion P |

Specimens 301 to 303 were prepared in the same compositions as used for the specimens 101 to 106 and the specimens 201 to 203, except that the emulsions N to S were used as shown in Table 11. The specimen 301 was of the present invention, and the specimens 302 and 303 were comparative.

The specimens 301 to 303 and the specimens 102, 104, and 106 were wedgewise exposed to white light. The specimens thus exposed were then subjected to development comprising 1st development lasting 6 min. (standard) and 8 min. (sensitization) in the same manner as in Example 2. Table 12 typically shows the relative sensitivity of cyan images obtained from the results of sensitometry in the same manner as in Example 1.

As apparent from Table 12, the specimens 301 to 303, which comprise internal latent image type emulsions, provide higher sensitivities and higher rise in sensitivity by sensitization as compared to the specimens 102, 104 and 106, which comprise the respective surface latent image type emulsions. However, the specimen 301 of the present invention shows a remarkably high rise in sensitivity upon sensitization process as compared to the comparative specimens 302 and 303. The difference between the specimen 301 and the specimens 302 and 303 in rise in sensitivity is greater than that between the specimen 102 and the specimens 104 and 105. Thus, it was found that the use of an internal latent image type emulsion promotes the effects of the present invention.

TABLE 12

| Specimen No. | Type of emulsion used | 1st development time (min.) | Relative sensitivity |
|---|---|---|---|
| 301 | Internal latent | 6 | 125 |
| | image type | 8 | 355 |
| 302 | Internal latent | 6 | 125 |
| | image type | 8 | 295 |
| 303 | Internal latent | 6 | 125 |
| | image type | 8 | 261 |
| 102 | Surface latent | 6 | 100 |
| | image type | 8 | 240 |
| 104 | Surface latent | 6 | 100 |
| | image type | 8 | 209 |
| 106 | Surface latent | 6 | 100 |
| | image type | 8 | 193 |

*Value relative to the sensitivity of the specimen 102 when it is subjected to standard treatment (6 min.)

While the invention has been described in detail and with reference to specific embodiments thereof, it will be apparent to one skilled in the art that various changes and modifications can be made therein without departing from the spirit and scope thereof.

I claim:

1. A silver halide color reversal photographic material having at least one light-sensitive silver halide emulsion layer on a support, comprising silver iodobromide grains having a silver iodide content of 5 mol % or less in at least one silver halide emulsion layer, wherein said silver iodobromide grains comprise a core phase comprising the center thereof and a shell phase covering said core and comprising the surface thereof, with the silver iodide content of said shell phase being higher than that of said core phase, wherein said silver iodobromide grains are tabular silver iodobromide grains which are present so as to amount to at least 50% of the total projected area of all silver iodobromide grains present and wherein said tabular silver halide grains have an average aspect ratio of from 5 to 8.

2. A silver halide color photographic material as in claim 1, wherein the difference in the silver iodide content between the core phase and the shell phase is at least 1 mol %.

3. A silver halide color photographic material as in claim 1, wherein the silver content of the core phase is in the range of from 5 to 95%, based on the total silver content of the grain.

4. A silver halide color photographic material as in claim 1, wherein the difference in the silver iodide content between the core phase and the shell phase is at least 3 mol %.

5. A silver halide color photographic material as in claim 1, wherein the silver iodide content of the core phase is 3 mol % or less.

6. A silver halide color photographic material as in claim 1, wherein the silver content of the core phase is in the range of from 20 to 80 mol %, based on the total silver content of the grain.

* * * * *